US005126726A

United States Patent [19]

Howard et al.

[11] Patent Number: 5,126,726

[45] Date of Patent: Jun. 30, 1992

[54] PICTURE ELEMENT ENCODING

[75] Inventors: Edwin O. Howard; Walter R. Steiner; Michael L. Morgan, all of Ormond Beach; Gregory C. Buchner, South Daytona; Richard Economy; Edward M. Sims, both of Ormond Beach, all of Fla.

[73] Assignee: General Electric Company, Philadelphia, Pa.

[21] Appl. No.: 457,876

[22] Filed: Dec. 27, 1989

[51] Int. Cl.[5] ..... G09G 1/06

[52] U.S. Cl. ..... 340/728; 340/703; 340/723

[58] Field of Search ..... 340/728, 723, 747, 744, 340/703, 393, 721; 358/456, 458, 465, 466, 467, 462; 382/50

[56] References Cited

U.S. PATENT DOCUMENTS

| | | | |
|---|---|---|---|
| 4,258,393 | 3/1981 | Ejiri et al. | 358/457 |
| 4,720,745 | 1/1988 | DeForest et al. | 358/166 |
| 4,721,943 | 1/1988 | Stallkamp | 340/793 |
| 4,803,548 | 1/1989 | Kirk | 358/36 |
| 4,837,562 | 6/1989 | Nishiura et al. | 340/728 |
| 4,849,746 | 7/1989 | Dubner | 340/728 |
| 4,908,780 | 3/1990 | Priem et al. | 340/723 |
| 4,992,955 | 2/1991 | Yabuuchi et al. | 358/456 |
| 4,998,122 | 3/1991 | Kanno et al. | 382/50 |

*Primary Examiner*—Ulysses Weldon
*Assistant Examiner*—Xiao Min Wu
*Attorney, Agent, or Firm*—Paul Checkovich; Geoffrey H. Krauss

[57] ABSTRACT

The values of an attribute, like color, to be assigned to the right and left half of a pixel of a display device, such as may be determined by a computer image generation system, are compared for determining a difference value. If the difference value is less than a predetermined threshold, an average of the left and right half values is assigned to the pixel. If the difference value is greater than or equal to the threshold, then the right and left half values are assigned to the respective right and left halves of the pixel and during the raster scan, the attribute value of the pixel to be displayed is transitioned at the beginning of the pixel interval and in the middle of the pixel interval so that the pixel presents an image in response to the corresponding right and left half values. The data for the left and right half values may be truncated and stored as a portion of the data word or may be encoded into logarithmetic form having a mantissa and shift code. In either case, the data word may be the same length as words previously used to define the color of a pixel, thereby avoiding having to alter memory allocation of existing systems.

15 Claims, 5 Drawing Sheets

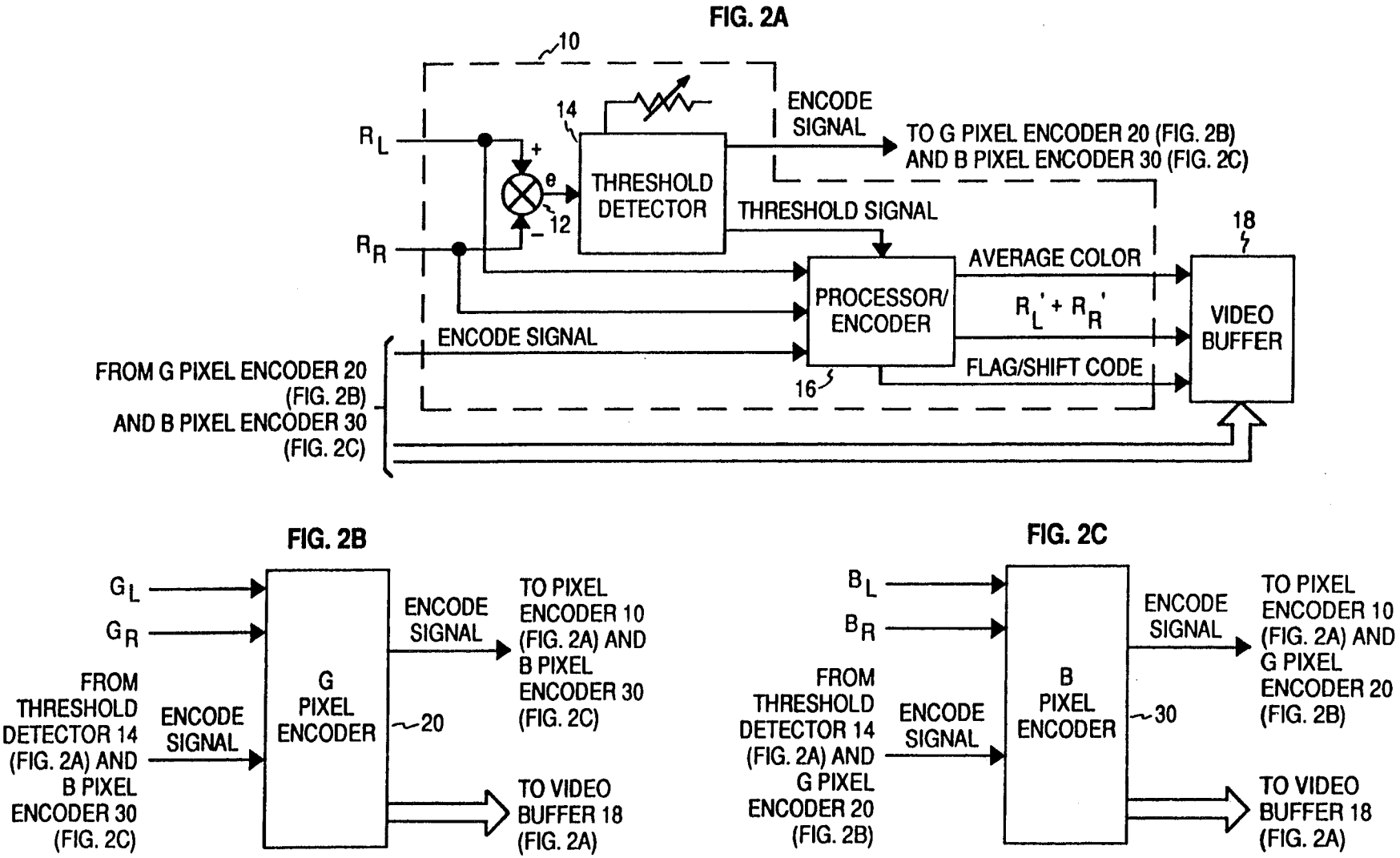
FIG. 2A
10
14
THRESHOLD DETECTOR
12
ENCODE SIGNAL
THRESHOLD SIGNAL
TO G PIXEL ENCODER 20 (FIG. 2B) AND B PIXEL ENCODER 30 (FIG. 2C)
PROCESSOR/ ENCODER
16
AVERAGE COLOR
$R_L' + R_R'$
FLAG/SHIFT CODE
18
VIDEO BUFFER
$R_L$
$R_R$
ENCODE SIGNAL
FROM G PIXEL ENCODER 20 (FIG. 2B) AND B PIXEL ENCODER 30 (FIG. 2C)
FIG. 2B
G PIXEL ENCODER
20
$G_L$
$G_R$
FROM THRESHOLD DETECTOR 14 (FIG. 2A) AND B PIXEL ENCODER 30 (FIG. 2C)
ENCODE SIGNAL
ENCODE SIGNAL
TO PIXEL ENCODER 10 (FIG. 2A) AND B PIXEL ENCODER 30 (FIG. 2C)
TO VIDEO BUFFER 18 (FIG. 2A)
FIG. 2C
B PIXEL ENCODER
30
$B_L$
$B_R$
FROM THRESHOLD DETECTOR 14 (FIG. 2A) AND G PIXEL ENCODER 20 (FIG. 2B)
ENCODE SIGNAL
ENCODE SIGNAL
TO PIXEL ENCODER 10 (FIG. 2A) AND G PIXEL ENCODER 20 (FIG. 2B)
TO VIDEO BUFFER 18 (FIG. 2A)

FIG. 3A
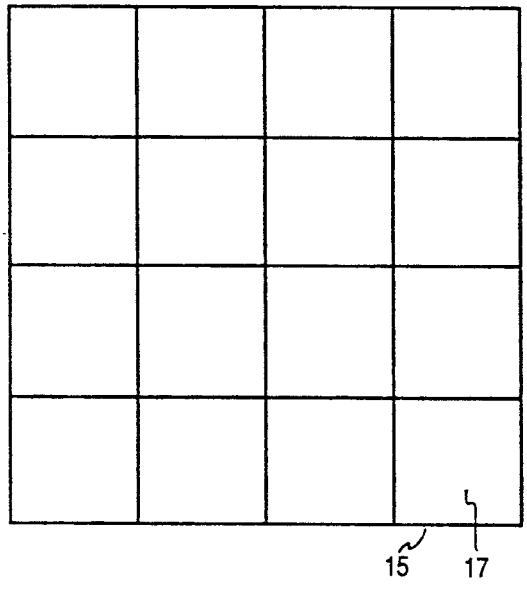
FIG. 3B
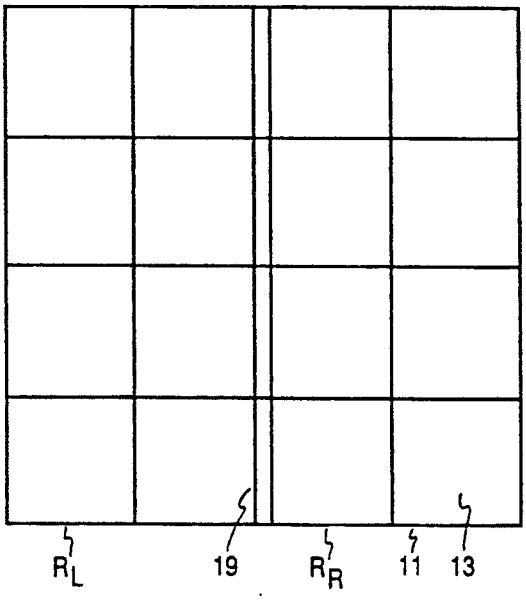
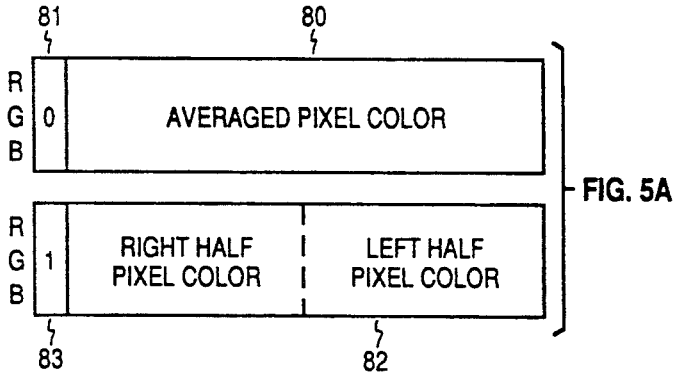
FIG. 5A
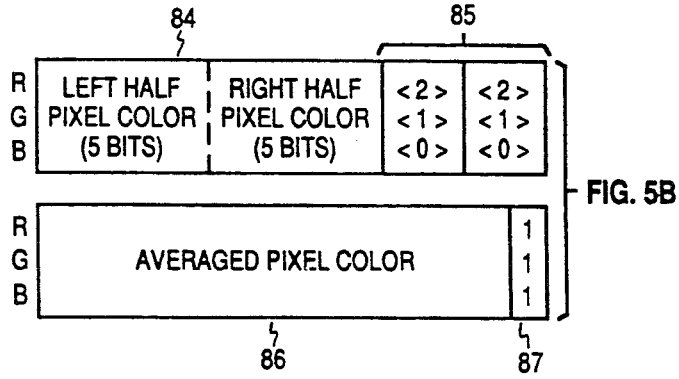
FIG. 5B

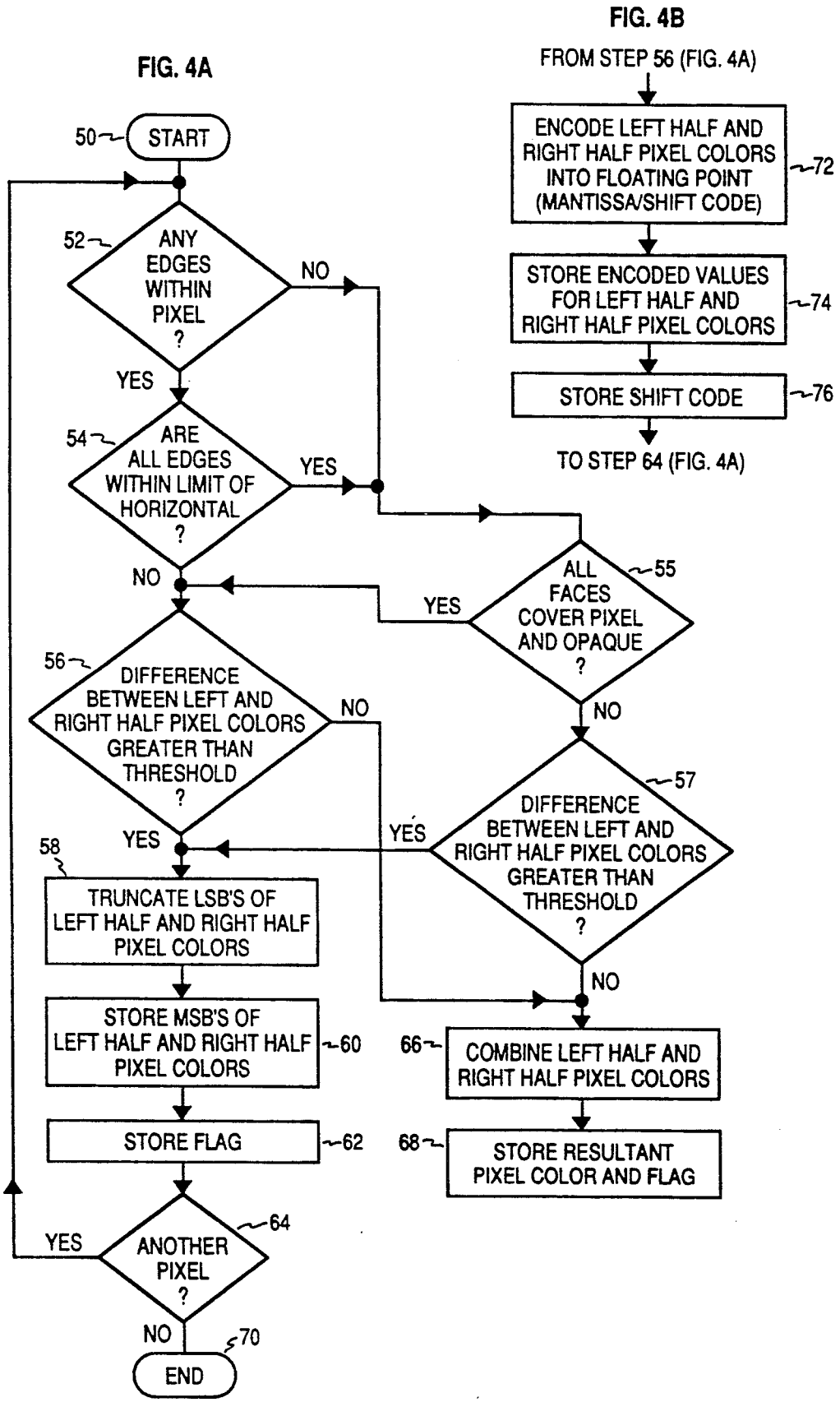
FIG. 4A
50
START
52
ANY EDGES WITHIN PIXEL ?
NO
YES
54
ARE ALL EDGES WITHIN LIMIT OF HORIZONTAL ?
YES
NO
55
ALL FACES COVER PIXEL AND OPAQUE ?
YES
NO
56
DIFFERENCE BETWEEN LEFT AND RIGHT HALF PIXEL COLORS GREATER THAN THRESHOLD ?
NO
YES
57
DIFFERENCE BETWEEN LEFT AND RIGHT HALF PIXEL COLORS GREATER THAN THRESHOLD ?
YES
NO
58
TRUNCATE LSB'S OF LEFT HALF AND RIGHT HALF PIXEL COLORS
STORE MSB'S OF LEFT HALF AND RIGHT HALF PIXEL COLORS
60
STORE FLAG
62
64
ANOTHER PIXEL ?
YES
NO
70
END
FIG. 4B
FROM STEP 56 (FIG. 4A)
ENCODE LEFT HALF AND RIGHT HALF PIXEL COLORS INTO FLOATING POINT (MANTISSA/SHIFT CODE)
72
STORE ENCODED VALUES FOR LEFT HALF AND RIGHT HALF PIXEL COLORS
74
STORE SHIFT CODE
76
TO STEP 64 (FIG. 4A)
66
COMBINE LEFT HALF AND RIGHT HALF PIXEL COLORS
68
STORE RESULTANT PIXEL COLOR AND FLAG

PICTURE ELEMENT ENCODING

BACKGROUND OF THE INVENTION

This invention relates to picture element (pixel) encoding, and, more particularly, to apparatus and method for increasing the resolution of a display by reducing pixel quantization effects.

In a typical display such as may be used in combination with a real-time computer image generation (CIG) system, an image of an object is presented to a viewer as a series of frames. Although the rate at which a frame is updated may vary, it is customary to use a 30 Hz update rate which corresponds to the update rate used for the NTSC television standard.

For a raster-scanned display, raster lines having a predetermined number of pixels per line are generated in response to video information generated by the CIG system. Pixels are generally square or rectangular portions of the display and are arranged in a grid. The lines of the raster may be presented in either an interlaced or non-interlaced format. In the interlaced format, two fields, each updated at say a 60 Hz rate, are used for presenting the respective odd and even lines of the frame. That is, after the lines of the odd field have been displayed, the lines of the even field are displayed between appropriate lines of the odd field. In non-interlaced format, the lines of the frame are generally sequentially presented.

The ultimate goal of a CIG system is to determine an attribute for an image to be displayed such as the color or shade of gray for monochrome system of each pixel of a display device, so that :;hen each pixel is displayed with its assigned color value, the desired image is formed on the display device. Descriptors of image features are typically stored as polygons, or faces. A common sampling scheme which assigns the color of a polygon to any pixel whose center is covered by the polygon as determined by a view ray from the observer through the pixel center to the polygons in viewer space results in aliasing, which may be manifested by a flashing effect along edges within the image.

One way to minimize aliasing is to supersample the pixel at subpixel locations. Each pixel is divided into a plurality of subpixels and the color of a polygon intercepted by a view ray passing through the center of the subpixel is assigned to the subpixel. After colors have been assigned to all subpixels, the color of the overall pixel may be determined, such as by averaging the colors of all subpixels of the pixel. Details of CIG systems for image processing may be had by reference to U.S. Pat. Nos. 4,727,365—Bunker et al; 4,811,245—Bunker et al; and 4,825,391—Merz, all assigned to the instant assignee and incorporated herein in their entirety by reference thereto.

In prior CIG systems, a continuum of colors may be displayed along a line of a raster subject to a restriction that color may not change faster than the bandwidth of the display device. For example, if a raster line contains 1024 pixels as supplied by the CIG system and the information from the CIG system is limited to changing only once for any pixel, then a color change, say from black to white or from white to black, in the space of less than one pixel cannot be displayed. However, generally there is no restriction placed on the display device as to where along the raster line a color change can occur, only a restriction on the rate or frequency of change. When a raster line is divided into pixels such as for accommodating output from CIG systems, then for previous CIG systems the raster would typically only change color at the start of each pixel. This limitation of color change location produces a quantization effect which does not always permit all color information to be accurately displayed, thereby reducing the modulation transfer function (MTF) of the system. In other words, when the color value of a pixel is allowed to change only at the beginning of a time interval (known as "pixel time"), which corresponds to the physical leading edge of a pixel and remain fixed throughout pixel time, MTF is limited.

The modulation transfer function is an indication of the resolution of a display system, or an indication of the quality of the rendition of an image obtained from a predetermined input value used to generate the image. Resolution may be regarded as the ability of a system to detect and/or display spaced apart edges. The closer edges are that may still be accurately detected or displayed, the higher the resolution.

Unless otherwise stated, white and black will be used as examples of contrasting colors throughout, wherein a color resulting from a combination of white and black is represented as shade of gray. It is to be understood that this invention is applicable to any colors including different intensities of the same color.

A standard test for determining MTF involves moving, or sampling, a bar pattern of alternating contrasting colors, wherein a bar of the pattern is about 1 to about 1.25 pixels wide, across the pixel grid and displaying the result. If the contrasting colors are say black and white, then a display of any color different from black or white, such as a shade of gray, represents a loss of information and a corresponding MTF of less than 100 percent.

It would be desirable to increase the MTF and thereby the resolution of image displays. Further, it would be desirable to effect such an increase with minimal hardware changes to existing computer image generation systems.

Accordingly, it is an object of the present invention to provide apparatus and method for increasing the modulation transfer function and thereby the resolution of image displays.

Another object of the present invention is to increase the MTF of image displays used in combination with a computer image generation system with minimal hardware changes to the computer image generation system.

SUMMARY OF THE INVENTION

In accordance with the present invention, apparatus for increasing the resolution of a display comprises difference means for producing a difference signal representative of the difference value between an attribute, such as color, of one portion of a pixel to be displayed and the attribute of another portion of the pixel to be displayed, comparator means for determining when the difference value is greater than a predetermined threshold, and processor means for assigning a first value of the attribute to the one portion of the pixel and a second value of the attribute to the another portion of the pixel when the difference value is greater than and equal to the threshold. The processor means is also for assigning a third value of the attribute to the pixel when the difference is less than the threshold.

The first, second and third values of the attribute may be provided to a display for controlling the display characteristic of the pixel to be displayed. If the third value is assigned, then the pixel to be displayed retains the third value throughout the pixel interval. If the first and second values are assigned to the one and another portions of the pixel to be displayed, then the first value is retained for the one portion and after a transition within the pixel interval the second value is retained for the another portion. The first and second values of the attribute may be respective averages of the attribute for the corresponding one and another portion, or respective parts of the one and another portion, such as may be determined by a computer image generation system.

The apparatus may further include a respective plurality of difference means, comparator means and processor means for processing a respective plurality of components of the attribute, such as red, green and blue color components of a color attribute for forming a full color image at the display.

In addition, the apparatus may include storage means, such as bulk disk or random access memory (RAM), for storing the assigned first, second and third values of the attribute at logical locations corresponding to the pixel.

Further, the apparatus may include switching means, such as a multiplexer, for selecting either the third value or the first value and the second value. When the first and second values are selected, the attribute for the one portion of the pixel is transitioned in response to the first value during the part of the pixel interval corresponding to the one portion and the attribute for the another portion of the pixel is transitioned in response to the second value during the part of the pixel interval corresponding to the another portion.

In another aspect of the present invention, a method for increasing resolution of an image to be displayed, wherein the image is formed from pixels having a respective attribute, such as color, and an interval assigned thereto comprises determining the difference between the attribute of one portion for the pixel and the attribute of another portion of the pixel, representing the pixel by a first value of the attribute when the difference is less than or equal to a predetermined threshold and representing the one portion by a second value of the attribute and the another portion by a third value when the difference is greater than the predetermined threshold. The attribute assigned to the pixel is at the second value for the one portion and at the third value for the another portion, wherein the value of the attribute assigned to the pixel is allowed to change during the pixel interval for effecting increased resolution.

The method may further include the first value represented by a data word having a first predetermined number of bits and representing the second and third values by respective second and third predetermined number of bits, wherein the sum of the second and third number of bits is less than or equal to the first number of bits. The second and third number of bits may be expressed as a respective mantissa and corresponding shift code. The color may be represented by Y (luminesce), I (in-phase chroma) and Q (quadrature chroma).

When the attribute is color, the color may include first, second and third color components, such as red, green and blue, and the method may further include determining the difference between the first, second and third color components of the one portion of the pixel and the corresponding first, second and third color components of the another portion of the pixel, representing the pixel by a first value of each of the first, second and third color components when each difference is less than or equal to a corresponding predetermined threshold and represents the one portion by a corresponding second value of each of the first second and third color components and the another portion of the pixel by a corresponding third value of each of the first, second and third color components when any difference is greater than the corresponding predetermined threshold.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

BRIEF DESCRIPTION OF THE DRAWING

FIGS. 2A, 2B and 2C are block diagrams of a pixel encoder for a respective color component in accordance with the present invention.

FIG. 3A is a pixel divided into subpixels in accordance with a previous computer image generation system.

FIG. 3B is an encoded pixel in accordance with the present invention.

FIG. 4A is a flow diagram for pixel encoding in accordance with an embodiment of the present invention.

FIG. 4B is a modification of the flow diagram of FIG. 3A in accordance with another aspect of the present invention.

FIG. 5A is a formatted pixel word in accordance with the encoding of FIG. 4A.

FIG. 5B is a formatted pixel word in accordance with the encoding of FIG. 4B.

DETAILED DESCRIPTION

Figure 1:
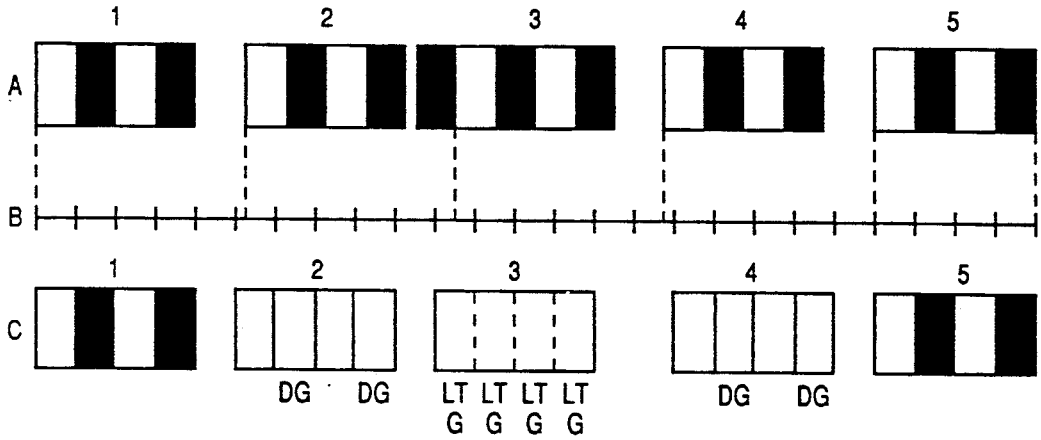
FIG. 1 is a bar code pattern and resultant display in accordance with a previous computer image generation system.

Referring to FIG. 1, a test bar code pattern A and resultant display C in accordance with a previous computer image generation system is shown.

Bar code pattern A is an alternating white and black pattern with each bar being one pixel wide. The short vertical lines transverse line B represent the beginning of each pixel and/or t e ending of the previous pixel. Bar code pattern C represents what is displayed in response to the corresponding input pattern of A when pattern A is sampled at pixel boundaries indicated in B. The indication DG refers to dark gray, that is a mixture of white and black with more black than white, and the indication LT/G refers to light gray, that is a mixture of white and black with more white than black.

Pattern A1 is aligned to start at a pixel edge and the resultant C1 pattern replicates the A1 pattern. As pattern A is sequentially shifted through phases A2, A3, A4 and A5 to commence at a respective one-quarter pixel later than the previous phase, it is noted that the corresponding phases C2, C3, C4 and C5 of displayed pattern C do not necessarily replicate the pattern of corresponding phases A2, A3, A4 and A5 of input pattern A. In fact for phase C3, wherein phase A3 is shifted so that the bars of phase A3 are centered on pixel boundaries indicated in row B, no unmodified original information is displayed.

Referring to FIGS. 2A, 2B and 2C, block diagrams of a pixel encoder for a respective color component in accordance with the present invention are shown. For achieving a full color display by a presently preferred combination of colors, the colors red (R), green (G) and blue (B) are chosen herein. Pixel encoder 10 for one color component, such as red (R), is shown in detail, it being understood that pixel encoders 20 and 30 for other color components, such as green (G) and blue (B) respectively, may be analogously configured. Application of the present invention is not limited to particular colors or to the number of colors or color components.

Pixel encoder 10 includes a summer 12 having a non-inverting input constituting an input of encoder 10 and an inverting input constituting another input of encoder 10, an adjustable or adaptive threshold detector 14 having an input connected to the output of summer 12 for receiving a difference signal e, therefrom, a processor-/encoder 16 having a pair of inputs each connected to a respective input of encoder 10 and respective outputs connected to respective inputs of video buffer 18 for providing a pixel average color signal, an encoder pixel color descriptor signal ($R'_L+R'_R$) and a flag/shift code signal thereto. The corresponding outputs from processor/encoder of G circuitry 20 and B circuitry 30 may be connected to respective portions of video buffer 18 or to a respective separate video buffer as desired.

When using a combination of colors, such as R, G and B, for forming a full color description of a pixel to be displayed, each of the R, G and B color components for a pixel are typically independently processed in parallel by the CIG system. Thus, during any predetermined interval, pixel encoders 10, 20 and 30 will be operating on red, green and blue color components, respectively, for the same pixel. Accordingly, an encode signal is supplied from another output of threshold detector 14, which also constitutes another output of pixel encoder 10, to each of G pixel encoder 20 and B pixel encoder 30 for signifying when an encode operation is detected by pixel encoder 20 as explained in detail below.

Referring to FIG. 3A, a pixel 15 that is subdivided into subpixels 17 is shown. In one prior processing scheme for determining the overall color value of pixel 15 which includes the combination of the red, green and blue color component values, the color value of the red color component of each subpixel 17 of pixel 15 is added and a resulting average for the red color component is assigned as the red color of pixel 15. The blue and green components are processed analogously. The assigned red, green and blue color values are ultimately supplied to a display device for generating an image. Typically the value of each color component may be adequately represented by a 12-bit word.

Referring to FIG. 3B, a pixel 11 also includes subpixels 13. However, in accordance with the present invention pixel 11 is also logically divided into right and left halves as shown by vertical lines 19. Lines 19 are shown as closely spaced lines to avoid confusion with the boundary lines of subpixels 13, it being understood that a single line may be used to indicate central vertical divider 19.

Conventionally pixel 11 as shown is oriented so that vertical lines 19 are transverse a raster line of the display. The red color component for each subpixel 13 for the left half of pixel 11 is designated $R_L$ and the red color component for each subpixel 13 of the right half of pixel 11 is designated $R_R$. Likewise the green (G) and blue (B) color components are designated by an appropriate left (L) and right (R) subscript.

It is noted that the present invention is not dependent on the number of subpixels 13 into which pixel 11 is divided. In fact, in order to achieve benefits of the present invention, it is not necessary that pixel 11 have any subpixels, in which case the value of color components $R_L$ and $R_R$ are also the value of the overall color component of the left and right half, respectively, of pixel 11.

Referring again to FIG. 2A, the value of right half red color component $R_R$ of subpixels 13 of pixel 11 is supplied to the inverting input of summer 12 and the value of left half red color component $R_L$ of subpixels 13 of pixel 11 is provided to the non-inverting input of summer 12. Color components $R_L$ and $R_R$ may each be represented by a 12-bit word for each subpixel 13 and pixel 11 and supplied from a CIG system. Left half red component $R_L$ may be the average value of the red color component of each subpixel 13 of the left half of pixel 11, while right half red color component $R_R$ may be the average value of the red color component of each subpixel 13 of the right half of pixel 11.

Right color component $R_R$ and left color component $R_L$ representing the brightness or intensity of the red color component of the corresponding portion of pixel 11, are algebraically combined by summer 12 and the difference signal e is supplied to threshold detector 14. Difference signal e represents the difference in color intensity between the right and left halves of pixel 11. If the value of difference signal e is less than a predetermined adjustable, or adaptive, threshold as determined by threshold detector 14, which may include a digital comparator, a threshold signal that is supplied to processor/encoder 16 is set to a no encode state. In such a case, right color component $R_R$ and left color component $R_L$ available at respective inputs of processor/encoder 16 are averaged by processor/encoder 16 and the resulting average value is supplied as the average red color signal whose value is to be stored at the logical red location in video buffer 18 corresponding to pixel 11.

If the value of difference signal e is greater than or equal to the predetermined threshold as determined by threshold detector 14, which in general indicates that an edge passes through the pixel, then the threshold signal is set to an encode state. In such a case, right color component $R_R$ and left color component $R_L$ are modified or encoded by processor/encoder 16 and are supplied in a modified state as the $R'_R$ and $R'_L$ signal to video buffer 18 for storage at the logical location corresponding to pixel 11. A flag/shift code signal, which is supplied by processor/encoder 16 to video buffer 18 is also set in this case to indicate that the $R'_R$ and $R'_L$ color component signals have been provided in an encoded, or divided, format.

In addition, if threshold detector 14 determines that difference signal e is greater than the predetermined threshold, then threshold detector sets the encode signal, which is provided to corresponding other color pixel encode circuitry 20 and 30, to indicate that an encode operation has been detected by pixel encoder 10. Receipt of an encode signal indicating that one pixel encoder has detected that an encode operation is to be performed, may be used to force the pixel encoder receiving such encode signal to encode the corresponding right and left half pixel color components, irrespective of whether the difference between the right and left half pixel component values has exceeded the corresponding predetermined threshold. If the size of memory storage is desired to be expanded for words having the same resolution as shown with respect to FIGS. 4A, 4B, 5A and 5B below to accommodate an individual shift code for each color, or the resolution of a word reduced to accommodate the individual shift code without expanding existing memory, then it is not necessary to use the encode signal for forcing encoding.

Referring to FIG. 4A, a flow diagram for pixel encoding in accordance with an embodiment of the present invention is shown. A general purpose computer, such as one conventionally used in CIG systems may be programmed for performing the steps required.

A program begins by executing step 52 to determine if there are any edges of faces within the pixel. Inasmuch as the present invention is directed to increasing horizontal resolution as conventionally designated, that is, along a raster line, step 52 is performed because there may be cases where the difference in intensity between the right and left half of the pixel exceeds the threshold and yet no vertical or substantially vertical edge of a face passes through the pixel. One example of this may be a hole in an object which is created by the CIG system using appropriate translucency coding, wherein the color seen through the hole is different from the color of the object. Substantially vertical as used herein means that the angle of the edge is greater than a predetermined angle from the horizontal if the edge were to be displayed and includes a vertical edge. If there are substantially vertical edges within the pixel when step 52 is performed then the YES path is followed for execution of step 54 which determines if all edges within the pixel are within a predetermined limit of a horizontal line through the pixel. Dividing a pixel 16 by vertical lines 19 for processing the pixel color components in right and left halves as shown in FIG. 3B is intended to increase horizontal resolution along a raster line. If an edge through pixel 16 is horizontal or substantially horizontal as determined by the predetermined limit, then the color contribution of the polygon of which the edge forms a part of the perimeter to the right and left halves of pixel 16 would be expected to be equal or substantially equal, respectively, and whose effect would be expected to be negated when processed by summer 12 (FIG. 2A).

If all edges are not within the predetermined limit when step 54 is performed then the NO path is followed and step 56 is executed to determine if the difference between the left and right half color component of the pixel is greater than a predetermined threshold. If the difference is greater than the threshold when step 56 is performed then the YES path is followed to step 58.

Performance of step 58 modifies the right $R_R$ and left $R_L$ color component descriptors of the pixel such as by truncating the least significant bits of the right $R_R$ and left $R_L$ descriptors to form modified color component descriptors $R'_R$ and $R'_L$, respectively. Step 60 is then executed to store the remaining MSB's of the data word describing the left and right half of the pixel, respectively, and performance of step 62 stores a flag sign to indicate that the color components of the pixel have been stored as left and right half descriptors.

As an example, if the original data word from the right $R_R$ and left $R_L$ color component descriptors of the pixel are each 12-bits long, then the lowest seven LSB's of each data word for the pixel may be truncated, retaining the highest five MSB's of each data word for storage in the word format 82 as shown in FIG. 5A. A flag bit 83 of data word 82 is also set to a logical one indicating that the color component descriptors of the pixel have been stored as left and right half color portions. It is noted that if the overall color component descriptor for the pixel, which was previously used, was also stored as a 12-bit word, then data word 82 can be stored in the same memory location as would have been the prior overall color component of the pixel, thereby avoiding the need for storage hardware memory allocation modification while achieving benefits of the present invention.

From step 62, the program proceeds to execute step 64 for determining if there is another pixel to be processed. If there is no other pixel to be processed when step 64 is performed then the program follows the NO path to step 70. Execution of step 70 ends the program until it is restarted by performance of step 50.

If there are no edges within the pixel when step 52 is executed then the program follows the NO path to step 55, or if all edges with the pi>el are within the predetermined limit of horizontal when step 54 is performed then the program follows the YES path to step 55. Execution of step 55 determines if all faces entirely cover the pixel and further if all such faces are opaque. If both conditions are true when step 55 is executed then the program follows the YES path to step 56, otherwise the program follows the NO path to step 57. Performance of step 57 determines if the difference between the left and right half color component values is greater than a predetermined threshold. If the difference exceeds the threshold when step 57 is performed the program follows the YES path to step 58.

If the difference is not greater than the threshold when step 57 is performed then the program follows the NO path to step 66, or if the difference between the left and right half color components of the pixel are not greater than the predetermined threshold when step 56 is executed then the program follows the NO path to step 66.

Execution of step 66 algebraically combines the values of the left half color component $R_L$ and the right half color component $R_R$ of the pixel and determines an average value. The program proceeds to step 68 whose performance stores the average value of the color component of the pixel along with a flag bit 81 set to a logical zero to indicate that the stored pixel component color information is stored as an average value, for the entire pixel as shown in word format 80 of FIG. 5A. From an original 12-bit color component descriptor, the average value stored by execution of step 68 may be an 11-bit word with one bit reserved for the flag bit. Thus, for storing the right and left half pixel color component information, average pixel color component information can be stored without need of modifying existing storage hardware memory allocation.

From step 68 the program proceeds to step 64. If execution of step 64 indicates that there is another pixel to be processed then the program follows the YES path to step 52 and the next pixel is processed as described above.

The threshold of step 56 is expected to be relatively low as the program arrives at step 56 directly from step 54 and is expected to be the same or slightly higher if the program arrives at step 56 directly from step 55. The threshold of step 57 is expected to be relatively high and greater than either threshold encounted at step 56. In any event, thresholds may be adjusted without undue experimentation to provide an optimum display as viewed by an observer.

In order to increase the dynamic range of the stored color component information, such as may be desirable during low brightness, or intensity, light level conditions, like displaying, for example, dawn, dusk, nighttime or other dimly illuminated scenes, it has been found that a logrithmic-like pixel color component description may be used. Pixel processing using this technique may be analogous to that shown and described with reference to FIG. 4A, with the exception that steps 58, 60 and 62 and associated description of FIG. 4A are replaced by steps 72, 74 and 76 as shown in FIG. 4B and the description to follow.

If the difference between the left and right half color component intensity of the pixel is greater than the threshold when step 56 or 57 is performed, then the YES path is followed to step 72. Execution of step 72 encodes the left half and the right half pixel color component information into a floating point format having a respective mantissa and a shift code, or exponent. Performance of step 74 stores the encoded values or mantissas for the left and right color components and execution of step 76 stores the left and right shift code for the corresponding mantissa. The program then proceeds to step 64 for processing as described above.

For determining the mantissa and the shift code it is necessary to examine the left and right half color component data word for each color component of the pixel. For a 12-bit data word for each half of the color component, the mantissa is selected as the five most significant bit positions starting with the bit position of the color component data word having the fewest MSB leading zeros until a logical one is encountered.

For example if the 12-bit right red data word has four MSB leading zeros and a logical one in the fifth MSB position, the 12-bit right green data word has five MSB leading zeros and a logical one in the sixth MSB position and the 12-bit right blue data word has six MSB leading zeros and a logical one in the seventh MSB position, then the right red data word would establish the basis for obtaining the shift code and mantissa for the right data words of all color components. For the example cited, the shift code for the modified right red data word would be four or 100 (binary) for the four leading zeros of the right red data word, and the mantissa of the modified right red data word would be the value of the next five data bit positions, that is bit 5 through 9 of the right red data word. Likewise, the mantissa for the right green and blue modified data words would be the value of data bit positions 5 through 9 of the green and blue data words, respectively, whereas the shift code for each of the modified green and blue data words would still be four. The mantissa for each modified right color component is stored in the format 84 illustrated in FIG. 5B. Inasmuch as there can be as many as seven leading zeros while still leaving a five-bit mantissa for a 12-bit color component data word, three bits having a respective predetermined bit value of the shift code 85 for each mantissa of the modified color component data word are used for shift code 85 if it is desired that the modified color component data word be no longer than twelve bits wide for ease of storage in accordance with the present invention, as explained above. Each of the three bit values of the shift code is assigned to a respective color component word at a predetermined position in the color component word.

The shift code bit values for the left and right columns of shift code 85 are indicated by the power of two or exponent within the angle brackets <>. Thus <o> represents $2^0$ or one's position, <1> represents $2^1$ or two's position and <2> represents $2^2$ or four's position. The right-hand column of shift code 85 represents the shift code for the right half mantissa and the left-hand column of shift code 85 represents the shift code for the left half mantissa. Thus, for the example cited above where the shift code was four (binary 100), the right-hand column of shift code 85 would read 100 from top to bottom.

If the difference between the left and right half of the pixel color component is not greater than the predetermined threshold when step 56 or 57 (FIG. 4A) is performed then steps 66 and 68 are executed as described above, except that execution of step 68 stores a shift code rather than a flag. The left and right half color components are combined and averaged and the resultant MSB are stored in the format 86 shown in FIG. 5B. The right shift code is stored as a binary 111 indicating that the associated data words represents an average color of the entire pixel.

It is to be understood that the present invention is not limited to using 12-bit words for pixel color component descriptors. However, regardless of the number of overall bits used, for obtaining the finest intensity differentiation between portions of the pixel, the total number of bits used for the color component description of each portion, or half, of the pixel (which generally will be equal for each portion of the pixel) should be the maximum number which along with any bits needed for flagging and/or shift encoding permits storage using the same memory allocation without modification as was used prior to application of the present invention. Of course, if it is desired to increase memory space allocation or add additional storage then the length of the data word descriptors for defining pixel color component contribution to the overall color of the pixel may be increased accordingly. In addition, the present invention is not limited by the word format selected. Any format which accurately conveys the information desired may be used.

Figure 6:
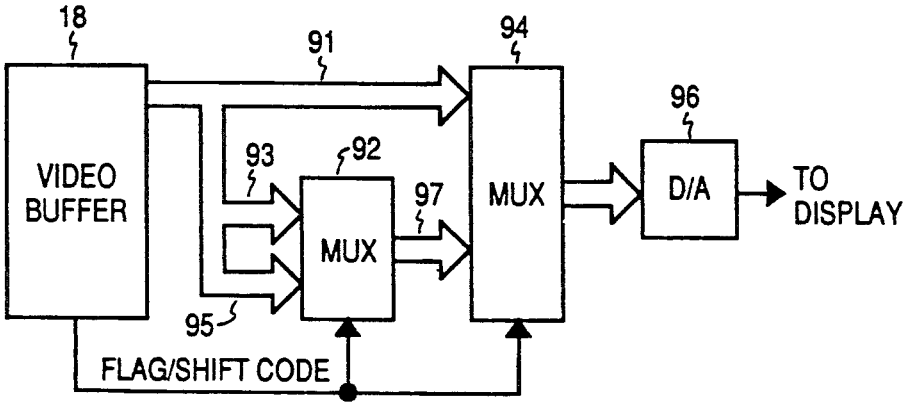
FIG. 6 is a block diagram of video processing circuitry useful with the present invention.

Referring to FIG. 6, a block diagram of video processing circuitry useful with the present invention is shown.

The video processing circuitry includes a pair of multiplexers (MUX) 92 and 94 and a digital to analog (D/A) converter 96. An output of video buffer 18 having pixel color component data available thereat is connected via data path 91 to an input of multiplexer 94 and via data paths 93 and 95 to two inputs of multiplexer 92.

Multiplexer 92 selects right pixel color information from data path 93 and left pixel color information from data path 95 in response to the status of the flag/shift code signal. Multiplexer 92 selects the average pixel color information from data path 91 or the right and left pixel color information from data path 97, which is available from the output of multiplexer 92, in response to the status of the flag/shift code signal. Corresponding pixel color information is provided to D/A converter 96 for ultimate display.

When the average pixel color information is selected by multiplexer 94, only one pixel color component value is supplied for display during each pixel interval. However, when left and right pixel color information is selected by multiplexer 94, then two color values are supplied for display during each pixel interval. That is, at the display, the color value of a pixel being displayed is changed, or transitioned, twice during a pixel interval, once at the beginning and once in the middle of the pixel interval in accordance with the present invention.

The circuitry of FIG. 6 is used for one color component. Analogous circuitry may be used for each other color component with the appropriate color component information available from video buffer 18 or a corresponding video buffer if another one is used for the color component.

Figure 7:
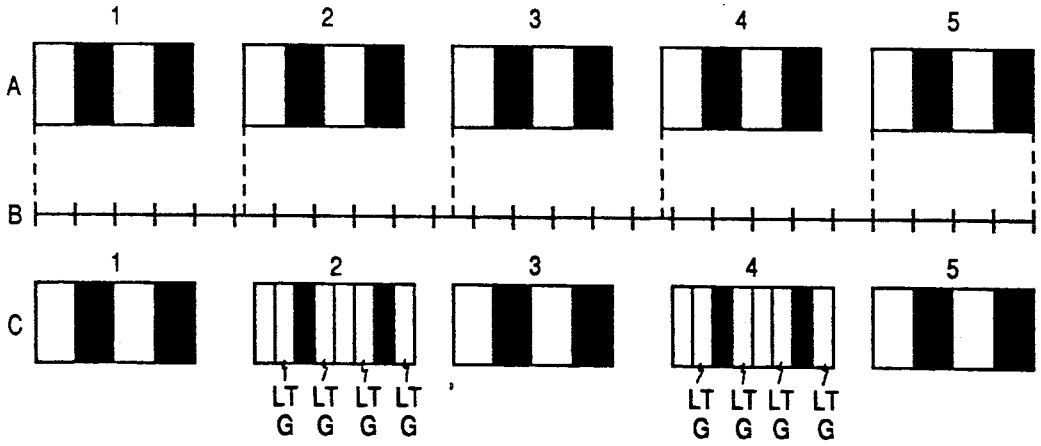
FIG. 7 is a bar code pattern and resultant display in accordance with the present invention.

Referring to FIG. 7, a bar code test pattern and resultant display in accordance with the present invention is shown. The bar code pattern of row A is the same pattern as was shown in Row A of FIG. 1. Likewise, the short transverse lines across row B represent the beginning or end of a pixel interval.

It is readily noted that the resultant output ultimately displayed as represented by the phases of Row C offers a significant improvement in MTF over that shown in row C of FIG. 1. For instance, it is recognized that output phase C3 of FIG. 7 replicates exactly input A3. Further, although some loss of information is indicated by the light gray (LTG) bands of phases C2 and C4 of FIG. 7, they are relatively narrow (one quarter pixel wide) and are separated by a band containing original (shown as black) information. Nowhere along row C is there shown an output representing a complete loss of original information as was the case in output C3 of FIG. 1.

It is to be understood that the present invention is not limited to dividing a pixel in half. Division into thirds, quarters or other portions with color component intensity comparisons performed between contiguous portions may be used subject to practical limitations of such as processing time available for maintaining real time image generation.

Figure 8A:
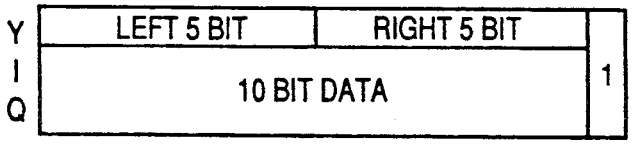
FIGS. 8A and 8B are formatted pixel words in accordance with another aspect of the present invention.
Figure 8B:
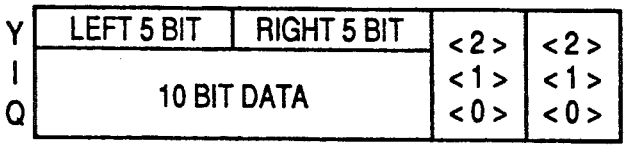

Referring to FIGS. 8A and 8B, formatted pixel words in accordance with another aspect of the present invention are shown.

The pixel word format shown in FIGS. 8A and 8B may be used in systems employing YIQ color processing wherein Y represents color luminesce (intensity), and I and Q represent in-phase and quadrature chroma, respectively. Inasmuch as all intensity information is encoded into the Y component, only the difference between the Y component values is necessary for determining whether to provide an overall or average Y component value for the entire pixel, or whether to provide individual portions, such as left half and right half information, along with the appropriate flag or shift code.

The Y component may be processed analogously to the red color component described above with respect to the flow diagram of FIG. 4A or FIG. 4B. When processing in accordance with the flow of FIG. 4A, and execution of step 58 indicates that truncation is appropriate then the word format of FIG. 8A, which is analogous to format 82 of FIG. 5A, may be used. Likewise, when processing in accordance with the flow of FIG. 4B, and execution of step 72 indicates that encoding is appropriate then the word format of FIG. 8B, which is analogous to format 84 of FIG. 5B, may be used.

Thus has been illustrated and described apparatus and method for increasing the modulation transfer function and thereby the resolution of image displays. Also shown and described was apparatus and method for increasing the modulation transfer function of image displays used in combination with a computer image generation system with minimal hardware changes to the computer image generation system.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. Apparatus for increasing the solution of a computer image generation system display, comprising:

first difference means for producing each pixel to be displayed a first difference signal representative of the first difference between an attribute of one portion of each single pixel to be displayed and the same attribute of another portion of that same pixel;

first comparator means, coupled to the first difference means, for determining in response to the first difference signal when the first difference is greater than a first predetermined threshold;

first processor means, coupled to the first comparator mans, for assigning a first value of the attribute to the one pixel portion of the particular single pixel and a second value of the attribute to the another portion of that same pixel when the first difference is greater than the first predetermined threshold, and also for assigning a third value of the attribute to the entire pixel when the first difference is not greater than the first predetermined threshold; and storage means, coupled to the first processor means, for storing the first and second value of the one and another portions of each single pixel when assigned and for storing the third value for the entire pixel when assigned, to cause the display modulation transfer function to increase during a pixel interval in which is displayed a pixel for which the first and second attributes are stored, with respect to the display modulation transfer function of another display pixel in a similar pixel interval and for which only the third attribute is stored.

2. The apparatus as in claim 1, wherein the attribute is color of the pixel.

3. The apparatus as in claim 1, wherein the comparator means includes an adjustable threshold detector.

4. The apparatus as in claim 1, wherein the third value is represented by a data word having a predetermined number of bits and the first and second values are each represented by respective first and second equal portions of another data word having a total of no more than the same predetermined number of bits.

5. The apparatus as in claim 4, wherein the respective first and second equal portions each include both a mantissa and a respective shift code for each mantissa.

6. The apparatus as in claim 2, wherein the attribute includes red, green and blue color components, the first difference means, first comparator means, first processor means and storage means further for responding to the red component of the attribute, the apparatus further comprising:

second difference means for producing for that same display pixel a second difference signal representative of the difference between the green component of the one portion of that one pixel then being processed and the green component of the another portion of that same single pixel;

second comparator means, coupled to the second difference means, for determining, in response to the second difference signal, when the second difference is greater than a second predetermined threshold;

second processor means, coupled to the second comparator means, for assigning a first value of the green component to the one pixel portion of the particular single pixel and a second value of the green component to the another portion of the one pixel when the second difference is greater than the second predetermined threshold, and also for assigning a third value of the green color component to the entire pixel when the second difference is not greater than the second predetermined threshold;

third difference means for producing for that same display pixel a third difference signal representative of the difference between the blue component of the one portion of that one pixel then being processed and the blue component of the another portion of that same single pixel;

third comparator means, coupled to the third difference means, for determining, in response to the third difference signal, when the third difference is greater than a third predetermined threshold;

third processor means, coupled to the third comparator means, for assigning a first value of the blue component to the one pixel portion of the particular single pixel and a second value of the blue component to the another portion of the one pixel when the third difference is greater than the third predetermined threshold, and also for assigning a third value of the blue component to the entire pixel when the third difference is not greater than the third predetermined threshold; and the storage means is also coupled to the second and third processor means for storing all of the first and second values of the green and blue components of the one and another portions of the single pixel when assigned, and for storing the third value of the green and blue components for the entire pixel when assigned, to cause the display modulation transfer function to further increase during a pixel interval in which is displayed a pixel for which the first and second values of the three color components are stored, with respect to the display modulation transfer function of another display pixel in a similar pixel interval and for which only the third value of the color components is stored.

7. The apparatus as in claim 1, further including:

first selector means coupled to the storage means for selecting, for display in response to the first difference, either the first and second value of the one and another portions of the pixel or the third value of the pixel.

8. The apparatus as in claim 2, wherein the color is expressed in Y (luminesce), I (in-phase chroma) and Q (quadrature chroma).

9. The apparatus is in claim 1, wherein the one portion of the pixel is the right half of the pixel and wherein the another portion of the pixel is the left half of the pixel.

10. A method for increasing resolution of an image to be displayed and formed by a computer image generation system from pixels, with each pixel having a respective attribute assigned thereto for display during a respective pixel interval, comprising the steps of:

determining the difference between the attribute of one portion of each single pixel and the attribute of another portion of the same pixel;

representing each single pixel by a first value of the attribute when the difference is not greater than a predetermined threshold; and representing the respective one and another pixel portions respectively by a second value and a third value of the attribute when the difference is greater than the predetermined threshold, to cause the value of the attribute assigned to that single pixel to change and effect an increase in resolution during the pixel interval.

11. The method as in claim 10, wherein the first value is represented by a data word having a first predetermined number of bits, the second recited representing step including:

representing the second value by a second predetermined number of bits;

representing the third value by a third predetermined number of bits, wherein the sum of the second and third predetermined number of bits is not greater than the first predetermined number of bits.

12. The method as in claim 11, further including:

expressing the second predetermined number of bits as a mantissa and a first corresponding shift code;

expressing the third predetermined number of bits as a mantissa and a second corresponding shift code.

13. The method as in claim 10, wherein the attribute is color and the color includes a first, second and third color component, the method further including:

determining the difference between the first, second and third color components of the one portion of the pixel and the corresponding first, second and third color components of the another portion of the pixel;

representing the pixel by a first value of each of the first, second and third color components when each difference is not greater than to a corresponding predetermined threshold;

representing the one portion of the pixel by a corresponding second value of each of the first, second and third color components and the another portion of the pixel by a corresponding third value of each of the first, second and third color components, when any difference is greater than the corresponding predetermined threshold.

14. The method as in claim 13, wherein the first, second and third color components are red, green and blue, respectively.

15. The method as in claim 10, wherein the attribute is color represented by Y (Luminesce), I (in-phase chroma) and Q (quadrature chroma).

* * * * *

UNITED STATES PATENT AND TRADEMARK OFFICE

CERTIFICATE OF CORRECTION

PATENT NO. : 5,126,726

DATED : June 30,1992

INVENTOR(S) : Edwin O. Howard et al

It is certified that error appears in the above-identified patent and that said Letters Patent is hereby corrected as shown below:

Column 12, line 14, after "producing" insert --for--.

Signed and Sealed this

Third Day of August, 1993

*Attest:*

Michael K. Kirk

MICHAEL K. KIRK

*Attesting Officer*

*Acting Commissioner of Patents and Trademarks*